United States Patent [19]

Griffith

[11] 4,194,539

[45] Mar. 25, 1980

[54] LOOM SHUTTLE

[75] Inventor: John D. Griffith, Cleadon, England

[73] Assignee: Bonas Machine Company Limited, Sunderland, England

[21] Appl. No.: 907,957

[22] Filed: May 22, 1978

[30] Foreign Application Priority Data

May 25, 1977 [GB] United Kingdom ..... 21991/77

[51] Int. Cl.[2] ..... D03J 5/06

[52] U.S. Cl. ..... 139/196.3; 139/436

[58] Field of Search ..... 139/436, 196.3, 224 R, 139/224 A, 198

[56] References Cited

U.S. PATENT DOCUMENTS

| | | | |
|---|---|---|---|
| 2,071,238 | 2/1937 | Sergerson | 139/198 |
| 2,570,872 | 10/1951 | Segee et al. | 139/198 |
| 3,195,580 | 7/1965 | Fend et al. | 139/224 R |
| 3,237,654 | 3/1966 | Hentz et al. | 139/224 R |
| 3,256,914 | 6/1966 | Hortmann | 139/224 R |
| 3,311,136 | 3/1967 | Rossman | 139/196.3 |

FOREIGN PATENT DOCUMENTS

| | | | |
|---|---|---|---|
| 240564 | 4/1960 | Australia | 139/436 |
| 2254974 | 7/1974 | Fed. Rep. of Germany | 139/224 R |
| 86774 | of 1895 | United Kingdom | 139/198 |
| 1081404 | 8/1967 | United Kingdom | 139/224 R |

*Primary Examiner*—Henry Jaudon

*Attorney, Agent, or Firm*—James E. Nilles

[57] ABSTRACT

A loom shuttle having a yarn receiving chamber including yarn restraining elements in the chamber, the yarn restraining elements are so arranged as to enable yarn to be loaded without restraint and to apply restraint to the yarn as it is being withdrawn thus to prevent entanglement of the yarn during withdrawal.

9 Claims, 5 Drawing Figures

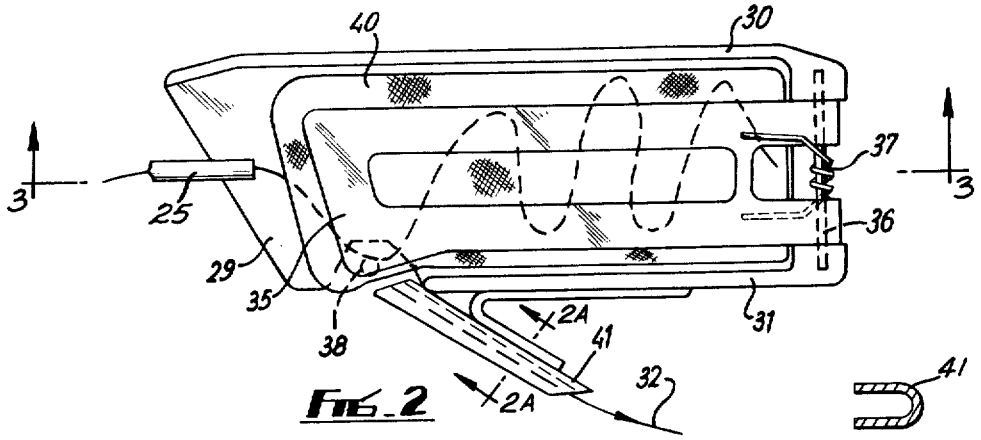
FIG. 2
FIG. 2A
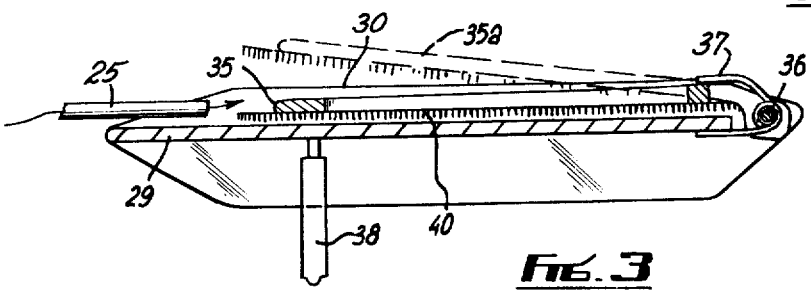
FIG. 3
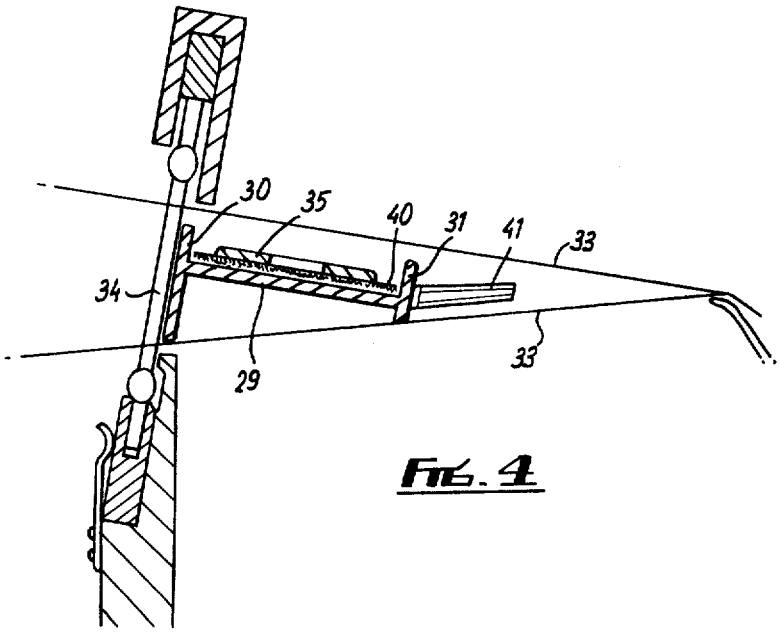
FIG. 4

LOOM SHUTTLE

BACKGROUND OF THE INVENTION

This invention concerns a loom shuttle and in particular though not exclusively a loom shuttle which can be used to advantage in a travelling wave shedding loom.

Loom shuttles have traditionally been designed to receive a bobbin or reel of yarn and, in use, the yarn has been withdrawn from the shuttle during weaving as the shuttle passes from side to side of a warp shed.

Since the advent of the travelling wave shedding loom shuttle design has been modified in such a manner as to be capable of receiving yarn which is randomly loaded into the shuttle, that is there is no bobbin or reel of yarn in the shuttle.

It is known to load the shuttle with yarn by entraining the yarn in an air stream to carry it into a yarn receiving chamber formed in the shuttle and while the yarn can be loaded effectively using this system it is found that during withdrawal of the yarn difficulties may be encountered due to a tendency of the yarn to leave the shuttle in a tangled manner. It is also found that, in particular when the shuttle yarn is almost exhausted the yarn leaving the shuttle may, in fact, contain knots.

SUMMARY OF THE INVENTION

It is therefore an object of the present invention to provide a shuttle adapted to contain randomly loaded yarn in which means are provided for ensuring that the yarn leaving the shuttle does so in an untangled or knotted condition.

A further object of the present invention is to provide a means whereby yarn from the shuttle can, in a simple manner, be transferred to the edge of a fabric being woven at the commencement of the insertion of the shuttle into the warp shed.

Thus according to one aspect of the present invention a loom shuttle including a yarn receiving chamber for randomly loaded yarn is characterised in that part at least of the yarn receiving chamber is provided with at least one yarn restraining element so arranged that, in use, yarn may be entered into the chamber substantially without restraint during loading and, during usage of the yarn to constrain it against free withdrawal thereby to prevent the formation of entanglements in the yarn.

Preferably all of the chamber walls are provided with inwardly projecting yarn restraining elements.

Conveniently the restraining elements in the yarn receiving chamber consist of serrated or roughened elements adapted to formed integrally with the chamber walls; alternatively there may be provided serrated elements adapted to be attached to the walls of the chamber. In a still further alternative there may be provided at least one wall lining element in the form of a piece of fabric or other resilient material.

Alternatively at least one of the walls of the chamber may be movable in one direction in order that the chamber size may effectively be enlarged thereby enabling weft yarn easily to be loaded and subsequently, after loading, may be movable in the opposite direction to serve to reduce the size of the chamber thereby to apply restraint to the yarn as it is being removed from the chamber.

Conveniently one wall element of the chamber is pivotally mounted at its end remote from the yarn entry/exit end to enable the chamber size to be increased and decreased.

The invention will now be described further, by way of example only, and with reference to the accompanying drawings in which:

FIG. 2 is a plan view of a shuttle.

FIG. 2a is an enlarged cross-sectional view taken on line 2A—2A of FIG. 2.

FIG. 3 is a sectional elevation of the shuttle referred to in FIG. 2; and FIG. 4 is a sectional end elevation of the shuttle referred to in FIG. 2.

DESCRIPTION OF THE INVENTION

Figure 1:
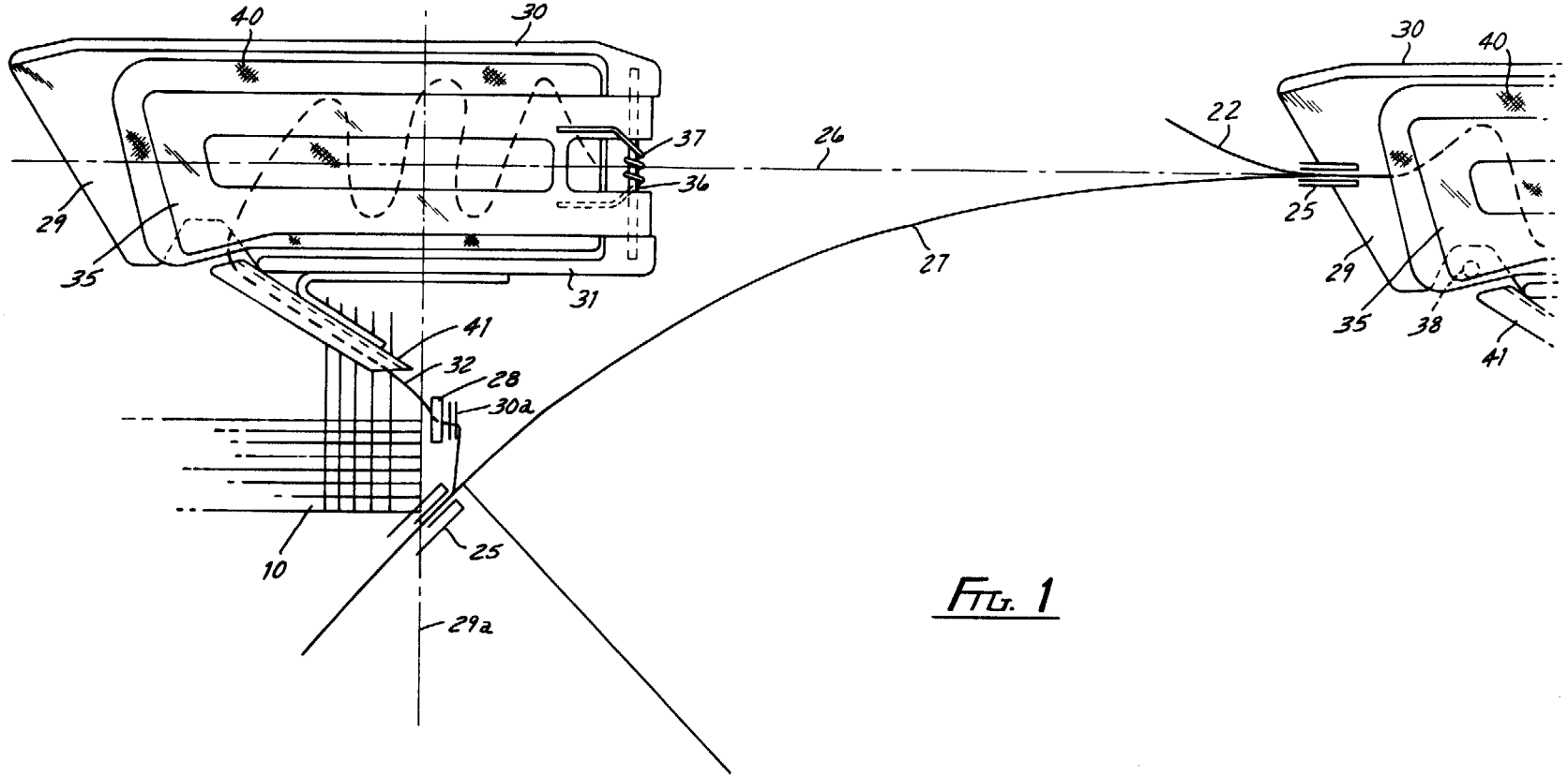
FIG. 1 is a somewhat schematic plan view showing an arrangement for loading a shuttle and moving it into a shed of warp yarns.

In the following description reference will be made to a shuttle for use in a travelling wave shedding loom but it should be appreciated that the invention is not restricted to shuttles for use in this type of loom only.

In use, to load the shuttle, yarn 22 (from a supply package, not shown) is entrained in an air stream to pass through a nozzle 25 which, in a travelling wave shedding loom, is moved in unison with a shuttle to be loaded through a loading station (see FIG. 1). Yarn 22 is thus blown in a random manner into a yarn chamber defined by walls 30, 31, base 29 and lid 35 of a shuttle yet to be described. The end of the yarn first entering the shuttle chamber being subsequently held by a pile fabric material 40 of the shuttle to be described. The yarn 22 enters the chamber in a substantially unrestricted manner.

When the shuttle is loaded (see FIG. 1) it moves towards the warp sheet along the path 26 and the nozzle 25 moves away from the shuttle along the path 27, the yarn 22 in the shuttle remaining joined to that in the nozzle 25 until the nozzle 25 reaches a position adjacent the selvedge 29 of a fabric 10 being woven. At this point the yarn 22 is entrapped by a gripper means 28 and is thereafter cut by a cutter 30 located between the gripper 28 and the nozzle 25. The end of the yarn 22 extending from the shuttle to the gripper 28 is thus held until the shuttle has moved partially through the warp shed and until it is held as a result of shed changes which take place sequentially across the shed during passage of the shuttle through the shed.

The invention is not restricted to the details set out above. For example the form of the shuttle is capable of being modified if necessary. Additionally the serrations and pins within the yarn chamber can be dispensed with, the chamber then having plain walls to one at least of which is secured a fabric or other resilient material is secured to constrain the yarn as it is removed from the shuttle during weaving. The presence of pile fabric whithin the chamber will not impede loading since, not only is the lid 35 held in an open position but also the pile will be "laid flat" (or at least deflected) by the air stream in which the yarn is entrained during loading of the shuttle. It is also possible to provide the shuttle base and side walls with serrated or roughened elements or to line them with pile fabric, if desired.

The shuttle is shown in FIGS. 2 to 4 and as can be seen one at least of the chamber walls is movable relative to the others whereby, by separating the walls effectively to enlarge the chamber, weft yarn can easily be loaded. Subsequent to loading of the chamber with weft yarn the movable wall or walls is or are moved in the opposite sense thus to reduce the size of the chamber to enable restraint to be applied to the yarn as it is being removed from the chamber. Thus as can be seen there is provided a shuttle the body of which has a base 29, and side walls 30 and 31. These side walls come above the base to house the weft yarn 32, and extend below the base so as to fit in the shed between warp yarns 33 and reed 34 of the loom. A lid 35 is attached to the body by a hinge 36, and is normally left pressed against the base of the body by a torsion spring 37 one end of which overlies the lid 35 while the other lies under the base 29. This lid is opened to position 35*a* by a rod 38 which pushes it upwards. In this open position, yarn from a nozzle 25 can be blown into the space between lid, base, and side walls. After loading the lid is allowed to shut, and the yarn in the shuttle is lightly held in place by the pressure between the lid and the base. To assist in even holding, a resilient material such as a pile fabric 40 is attached to the underside of the lid.

The presence of pile fabric within the chamber will not impede loading since, not only is the lid 35 held in an open position but also the pile will be "laid flat" (or at least deflected) by the air stream in which the yarn is entrained during loading of the shuttle. It is also possible to provide the shuttle base and side walls with serrated or roughened elements or to line them with pile fabric, if desired. The yarn can be withdrawn through a U-shaped guide 41 the open side of which faces towards the nose of the shuttle. Snarling on withdrawal is prevented by the fact that the yarn loops inside the shuttle are lightly held in place.

It should be appreciated that a wall other than the uppermost may be movable to increase or decrease the chamber size and that such movable wall may be moved other than about a hinge pin.

What we claim is:

1. A loom shuttle for use with a traveling wave shedding loom including a yarn chamber having an entry/exit opening for receiving randomly loaded yarn characterized in that the yarn chamber is provided with movable means resiliently loaded to restrain full opening which during loading of the yarn is adapted to open only slightly to effectively serve to increase the chamber size to enable yarn to be entered into the chamber through said opening substantially without restraint and with restraining means arranged, during usage of the yarn, to restrain it against free withdrawal through said opening thereby to prevent the formation of entanglements in the yarn.

2. A loom shuttle as claimed in claim 1 in which the movable means of the chamber is provided in the form of a resiliently loaded lid.

3. A loom shuttle as claimed in claim 2 in which the restraining means is attached to the lid of the chamber.

4. A loom shuttle as claimed in claim 2 in which the restraining means is in the form of a piece of fabric secured to the lid of the chamber.

5. A loom shuttle as claimed in claim 4 in which the fabric is a pile fabric.

6. A loom shuttle as claimed in claim 1 in which the restraining means consist of serrations formed integrally with at least one of the chamber walls.

7. A loom shuttle as claimed in claim 1 in which the restraining means for the yarn is in the form of inwardly projecting yarn elements on at least the resiliently loaded movable means of the chamber.

8. A loom shuttle as claimed in claim 1 in which the restraining means is resilient material such as foamed plastics material.

9. A loom shuttle as claimed in claim 1 in which there is provided a rounded nose on one wall of the chamber, said nose being located at the yarn entry/exit opening of the chamber.

* * * * *